US011293289B2

(12) United States Patent
Griffin et al.

(10) Patent No.: US 11,293,289 B2
(45) Date of Patent: Apr. 5, 2022

(54) SHROUDED BLADES WITH IMPROVED FLUTTER RESISTANCE

(71) Applicants: Siemens Energy Global GmbH & Co. KG, Munich (DE); Blade Diagnostics Corporation, Pittsburgh, PA (US)

(72) Inventors: Jerry H. Griffin, Pittsburgh, PA (US); Yuekun Zhou, Charlotte, NC (US)

(73) Assignees: Siemens Energy Global GmbH & Co. KG, Munich (DE); Blade Diagnostics Corporation, Pittsburgh, PA (US)

( * ) Notice: Subject to any disclaimer, the term of this patent is extended or adjusted under 35 U.S.C. 154(b) by 102 days.

(21) Appl. No.: 16/491,405

(22) PCT Filed: Feb. 26, 2018

(86) PCT No.: PCT/US2018/019686
§ 371 (c)(1),
(2) Date: Sep. 5, 2019

(87) PCT Pub. No.: WO2018/169665
PCT Pub. Date: Sep. 20, 2018

(65) Prior Publication Data

US 2020/0032658 A1 Jan. 30, 2020

Related U.S. Application Data

(60) Provisional application No. 62/470,471, filed on Mar. 13, 2017.

(51) Int. Cl.
*F01D 5/22* (2006.01)

(52) U.S. Cl.
CPC ..... *F01D 5/225* (2013.01); *F05D 2240/301* (2013.01); *F05D 2240/80* (2013.01); *F05D 2260/961* (2013.01)

(58) Field of Classification Search
CPC ... F01D 5/045; F01D 5/06; F01D 5/10; F01D 5/16; F01D 5/22; F01D 5/225; F01D 25/06; F05D 2260/961
(Continued)

(56) References Cited

U.S. PATENT DOCUMENTS 1,639,247 A 8/1927 Zoelly et al.
3,588,278 A * 6/1971 Ortolano ..... F01D 5/225 416/190
(Continued)

FOREIGN PATENT DOCUMENTS

| | | | |
|---|---|---|---|
| CN | 104727858 | A | 6/2015 |
| EP | 1881163 | A1 | 1/2008 |
| JP | 2015068342 | A | 4/2015 |

OTHER PUBLICATIONS

PCT International Search Report and Written Opinion dated May 4, 2018 corresponding to PCT Application No. PCT/US2018/019686 filed Feb. 26, 2018.

*Primary Examiner* — Christopher Verdier
*Assistant Examiner* — Michael K. Reitz

(57) ABSTRACT

A bladed rotor system includes a circumferential row of blades mounted on a rotor disc. Each blade includes an airfoil and a shroud attached to the airfoil at a span-wise height of the airfoil. The row of blades includes a first set of blades and a second set of blades. The airfoils in the first and second set of blades have substantially identical cross-sectional geometry about a rotation axis. The blades of the second set are distinguished from the blades of the first set by a geometry of the shroud that is unique to the respective set, whereby the natural frequency of a blades in the first and second sets differ by a predetermined amount. Blades of the first set and the second set alternate in a periodic fashion in
(Continued)

said circumferential row, to provide a frequency mistuning to stabilize flutter of the blades.

6 Claims, 4 Drawing Sheets

(58) Field of Classification Search
USPC ..... 416/194, 196 R
See application file for complete search history.

(56) References Cited

U.S. PATENT DOCUMENTS

| | | | | |
|---|---|---|---|---|
| 5,511,948 | A * | 4/1996 | Suzuki | F01D 5/225 416/191 |
| 5,667,361 | A | 9/1997 | Yaeger et al. | |
| 2011/0274549 | A1* | 11/2011 | Krikunov | F01D 5/22 416/212 R |
| 2013/0089424 | A1* | 4/2013 | Frischbier | F01D 5/027 416/182 |
| 2014/0072432 | A1 | 3/2014 | Woehler et al. | |
| 2014/0348657 | A1* | 11/2014 | Stiehler | F01D 5/26 416/190 |
| 2015/0089809 | A1 | 4/2015 | Guo et al. | |
| 2015/1076413 | | 6/2015 | Weber et al. | |
| 2017/0058681 | A1 | 3/2017 | Martin, Jr. et al. | |

* cited by examiner

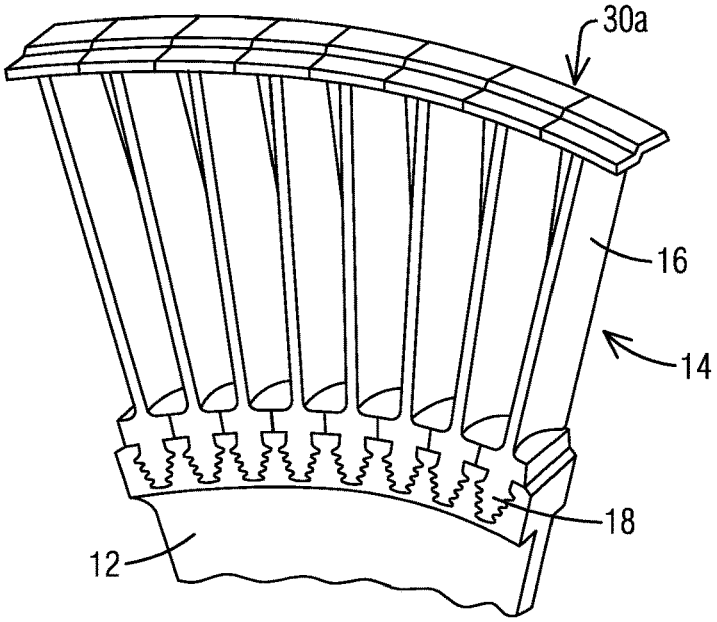
FIG. 1
FIG. 2
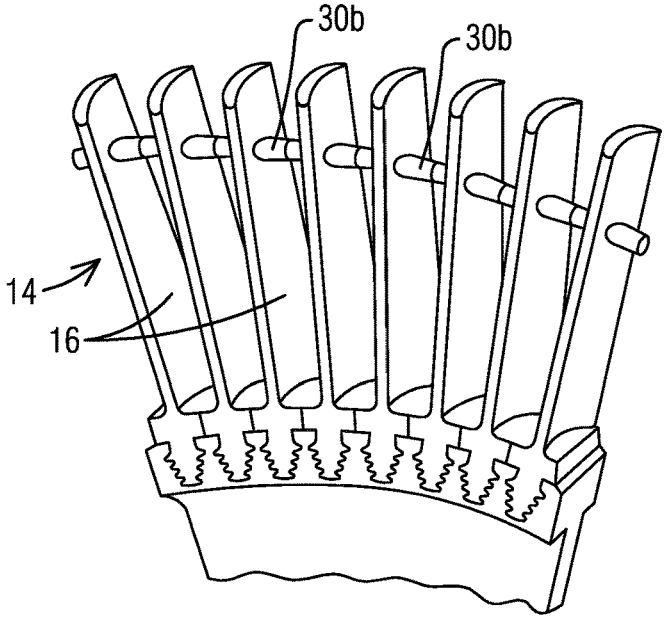
FIG. 3
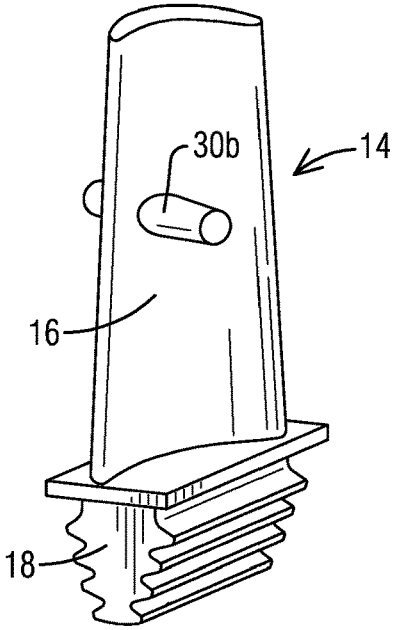

SHROUDED BLADES WITH IMPROVED FLUTTER RESISTANCE

BACKGROUND

1. Field

The present invention is relates to rotating blades in a turbomachine, and in particular, to a row of shrouded blades with alternate frequency mistuning for improved flutter resistance.

2. Description of the Related Art

Turbomachines, such as gas turbine engines include multiple stages of flow directing elements along a hot gas path in a turbine section of the gas turbine engine. Each turbine stage comprises a circumferential row of stationary vanes and a circumferential row of rotating blades arranged along an axial direction of the turbine section. Each row of blades may be mounted on a respective rotor disc, with the blades extending radially outward from the rotor disc into the hot gas path. A blade includes an airfoil extending span-wise along the radial direction from a root portion to a tip of the airfoil.

Typical turbine blades at each stage are designed to be identical aerodynamically and mechanically. These identical blades are assembled together into the rotor disc to form a bladed rotor system. During engine operation, the bladed rotor system vibrates in system modes. This vibration may be more severe in large blades, such as in low pressure turbine stages. An important source of damping in the modes is from aerodynamic forces acting on the blades when the blades vibrate. Under certain conditions, the aerodynamic damping in some of the modes may become negative, which may cause the blades to flutter. When this happens, the vibratory response of the system tends to grow exponentially until the blades either reach a limit cycle or break. Even if the blades achieve a limit cycle, their amplitudes can still be large enough to cause the blades to fail from high cycle fatigue.

In order to increase the blade natural frequency and decrease the tendency of the blades to flutter, blades may be provided with tip-shrouds or snubbers. The difference between a snubber and a tip-shroud is that a tip-shroud is disposed over the tip of the airfoil, while a snubber is generally disposed away from the tip, typically attached at a mid-span of the airfoil. FIG. 1 illustrates turbine blades with tip-shrouds 30*a*, while FIG. 2-3 illustrate turbine blades with mid-span shrouds or snubbers 30*b*. Both tip-shrouds and snubbers work on the same principle: An airfoil is typically installed on the rotor disk with a pre-twist. During engine operation, the airfoil tends to untwist due to centrifugal forces. The tip-shroud or snubber, which is attached to the airfoil, comes into contact with adjacent tip-shrouds or snubbers, due to the rotation of the blades, to form a ring when the blades reach a certain rotational speed. The ring provides a constraint that causes the frequencies of the blades to increase, which decreases the tendency of the blades to flutter.

However, there remains room for improvement to better address the problem of blade vibration.

SUMMARY

Briefly, aspects of the present invention are directed to shrouded blades with alternate frequency mistuning for improved flutter resistance.

According a first aspect of the present invention, a bladed rotor system for a turbomachine is provided. The bladed rotor system comprises a circumferential row of blades mounted on a rotor disc. Each blade comprises an airfoil extending span-wise along a radial direction from a root portion to an airfoil tip, and a shroud attached to the airfoil at a span-wise height of the airfoil. In operation, shrouds of adjacent blades abut circumferentially. The row of blades comprises a first set of blades and a second set of blades. The airfoils in the first and second set of blades have substantially identical cross-sectional geometry about a rotation axis. The blades of the second set are distinguished from the blades of the first set by a geometry of the shroud that is unique to the respective set, whereby the natural frequency of a blade in the second set differs from the natural frequency of a blade in the first set by a predetermined amount. Blades of the first set and the second set alternate in a periodic fashion in said circumferential row, to provide a frequency mistuning to stabilize flutter of the blades.

According to a second aspect of the invention, a blade for a row of blades in a turbomachine is provided. The blade comprises an airfoil extending span-wise along a radial direction from a root portion to an airfoil tip, and a shroud attached to the airfoil at a span-wise height of the airfoil. The blade is designed to be identical to a first set of blades or a second set of blades in the row. The airfoils in the first and second set of blades have substantially identical cross-sectional geometry about a rotation axis. The blades of the second set are distinguished from the blades of the first set by a geometry of the shroud that is unique to the respective set, whereby the natural frequency of a blade in the second set differs from the natural frequency of a blade in the first set by a predetermined amount. Blades of the first set and the second set alternate in a periodic fashion in said circumferential row, to provide a frequency mistuning to stabilize flutter of the blades.

BRIEF DESCRIPTION OF THE DRAWINGS

The invention is shown in more detail by help of figures. The figures show preferred configurations and do not limit the scope of the invention.

FIG. 1 illustrates a row of rotating blades with tip-shrouds;

FIG. 2 illustrates a row of rotating blades with snubbers;

FIG. 3 is a perspective view of an individual blade with a snubber attached to mid-span of the blade airfoil;

DETAILED DESCRIPTION

Figure 4:
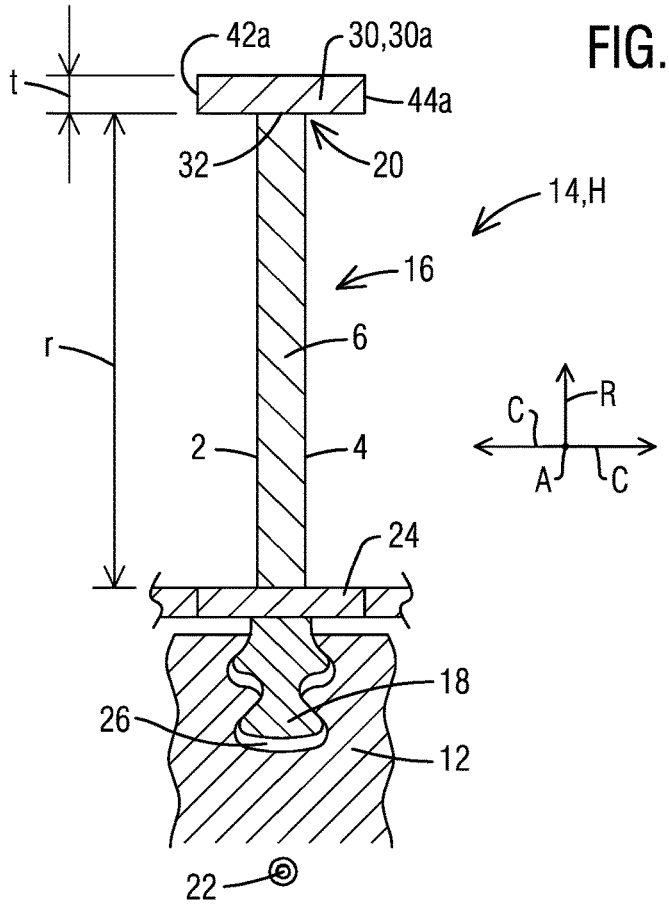
FIG. 4 is a schematic illustration of an axial end view of a regular blade with a tip-shroud.

In the following detailed description of the preferred embodiments, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

In the drawings, the direction A denotes an axial direction parallel to an axis of the turbine engine, while the directions R and C respectively denote a radial direction and a circumferential direction with respect to said axis of the turbine engine.

Illustrated embodiments of the present invention are directed to shrouded turbine blades in a turbine section of a gas turbine engine. However, the embodiments herein are merely exemplary. Alternately, for example and without limitation, aspects of the present invention may be incorporated in fan blades at the entry of a compressor section of an aviation gas turbine engine.

It has been found that alternate frequency mistuning can cause system modes to be distorted, so that that the resulting new, mistuned system modes are stable, i.e., they all have positive aerodynamic damping. It is therefore desirable to be able to design blades with a certain amount of predetermined alternate mistuning. Alternate mistuning may be implemented in blades by having the blades in the row alternate between high and low frequencies in periodic fashion in the circumferential direction. So far, alternate mistuning of blades has been implemented by modifying the mass and/or geometry of the airfoil in alternate blades in a blade row.

Embodiments of the present invention are based on the principle of modifying a geometry of the shroud for a set of blades in the blade row, so that said set of blades are mistuned, having a different frequency in relation to the rest of the blades in the blade row. In accordance with the illustrated embodiments depicted in FIG. 4-7, a circumferential row of blades 14 mounted on a rotor disc 12 may comprises a first set H of blades 14 and a second set L of blades 14. The airfoils 16 in the first set H and the second L set of blades 14 have essentially identical cross-sectional geometry about the rotation axis 22. That is, the airfoil cross-sectional shape as well as the angle of the airfoil chord with the rotation axis 22 is essentially constant across the first set H and the second set L of blades 14. Further, in the context of the illustrated embodiments, it may be assumed the each blade 14 of the row has essentially identical fir-tree attachments (blade root) for mounting the blade 14 on the rotor disc 12. The blades 14 of the second set L are distinguished from the blades 14 of the first set H by a geometry of the shroud 30 that is unique to the respective set H or L. Thereby the natural frequency of a blade 14 in the second set L differs from the natural frequency of a blade 14 in the first set H by a predetermined amount. In the illustrated examples, the blades 14 in the second set L are mistuned, having a lower frequency than the blades 14 of the first set H. The blades 14 of the first set H and the second set L may alternate in a periodic fashion (i.e., in alternating groups of one or more blades of each set) in said circumferential row, to provide frequency mistuning to stabilize flutter of the blades 14.

In the context of the specification, the term "shroud" may refer to a tip-shroud which is attached at a tip of a blade airfoil, or to a snubber which is attached at a mid-span region of a blade airfoil. A mid-span region may be understood to be any region located between the root and the tip of the airfoil. In exemplary embodiments, mid-span snubbers may be located between 40-70% of the span of the airfoil as measured from the root.

Referring now to FIG. 4, a turbine blade 14 includes an airfoil 16 extending span-wise along a radial direction. As known to one skilled in the art, the airfoil 16 may comprise a generally concave pressure side 2 and a generally convex suction side 4, joined at a leading edge 6 and at a trailing edge (not shown). A radially inner end of the airfoil 16 is coupled to a root 18 at a platform 24. In the illustrated embodiment, the root 18 has a fir-tree shape, which fits into a correspondingly shaped slot 26 in a rotor disk 12. In order to increase the blade natural frequency and decrease the tendency to flutter, the blade 14 may be provided with a circumferentially extending shroud 30. In the embodiment of FIG. 4, the shroud 30 is a tip-shroud 30*a* attached to an airfoil tip 20 at a radially outer end of the airfoil 16. The airfoil 16 has a radial length r as measured from the root to tip, while the tip-shroud 30*a* has a radial thickness t. Multiple blades 14 are installed around the circumference of the rotor disk 12 to form a blade row. The platforms 24 of adjacent blades 14 in the blade row abut each other to form an inner flowpath boundary for a hot gas, and the airfoils 16 extend radially outward across the flowpath.

Each blade airfoil 16 may be twisted about its span-wise axis. During engine operation, the blades 14 rotate about a rotation axis 22, whereby centrifugal and aerodynamic forces untwist each blade airfoil 16 in the blade row so that a pressure side contact edge 42*a* of each tip-shroud 30*a* abuts a suction side contact edge 44*a* of a tip-shroud 30*a* of the neighboring blade 14 in the row, to form a continuous shroud ring. The abutting contact between neighboring tip-shrouds 30*a* helps to limit the untwisting of the blade and establish the blade's precise orientation during operation. The shroud ring provides a constraint that causes the frequencies of the blades to increase, which decreases the tendency of the blades to flutter.

In accordance with the illustrated embodiment, a geometry of the tip-shroud 30*a* may be modified for a set of blades in the blade row, so that said set of blades are mistuned, having a different frequency in relation to the rest of the blades in the blade row.

Figure 5:
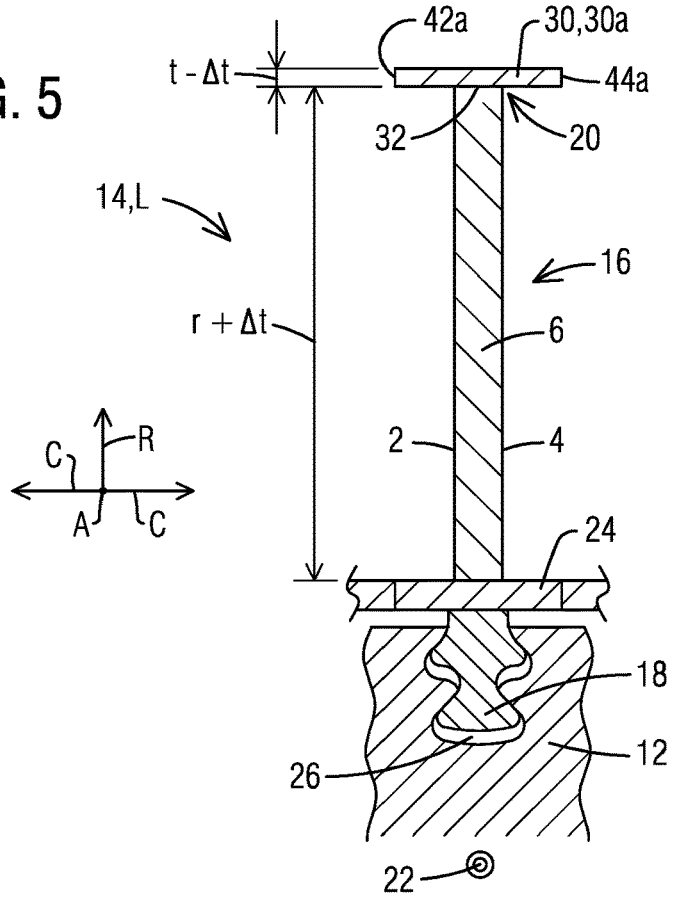
FIG. 5 is a schematic illustration of an axial end view of a mistuned blade with a thinner tip-shroud according an example embodiment of the invention.

FIG. 5 illustrates a mistuned blade of a blade row (i.e., belonging to the second set L having a lower frequency) in accordance with a first embodiment of the invention. For the purpose of illustration, let it be assumed that a regular blade in the blade row (i.e., belonging to the first set H having a higher frequency) has the same geometry as depicted in FIG. 4. As shown, the mistuned blade 14 has a thinner tip-shroud 30*a*, having a radial thickness $t-\Delta t$, where t is the radial thickness of a tip-shroud 30*a* of a blade of the first set H (see FIG. 4), and $\Delta t$ is the difference in radial thickness between the tip shrouds 30*a* of the first set H and the second set L. A thinner tip-shroud 30*a* reduces the natural frequency of the mistuned blade 14. The difference in radial thickness $\Delta t$ of the tip-shrouds 30*a* may be compensated by correspondingly increasing the radial length of the airfoil 16 of the mistuned blade to $r+\Delta t$, as shown in FIG. 5. Thereby, for a particular row of blades, the overall length of the blades r+t may be the same for all blades 14.

Figure 6:
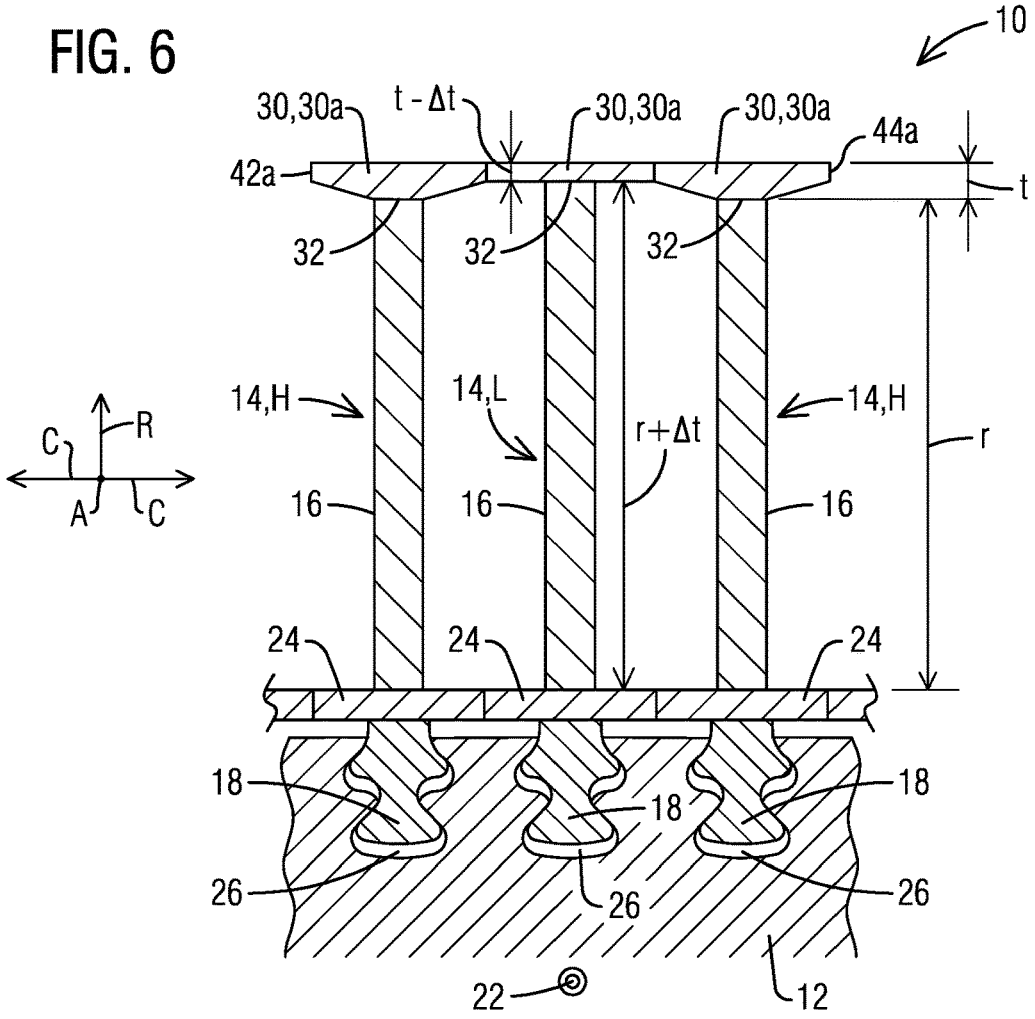
FIG. 6 is a schematic illustration of an axial end view of a row of blades, depicting a thin tip-shrouded blade between two thick tip-shrouded blades according an example embodiment of the invention.

FIG. 6 shows portion of a bladed rotor system 10 according to a variant of the inventive concept, depicting a thin tip-shrouded (mistuned) blade between two thick tip-shrouded (regular) blades. As shown, the tip-shrouds 30*a* in the second set L have a smaller mean radial thickness in relation to the tip-shrouds 30*a* in the first set H. As shown, he radial thickness of the tip-shrouds 30*a* at the point of attachment 32 with the airfoil tip is t for the blades in the first set H, while the radial thickness of the tip-shrouds 30*a* at the point of attachment 32 with the airfoil tip is $t-\Delta t$ for the blades in the second set L. As shown, the airfoil 16 in the second set L has a correspondingly larger radial length (r+Δt) from the root portion 18 to the airfoil tip 20, in relation to the airfoils 16 in the first set H (which have a radial length r). Thereby, a sum total (r+t) of the radial length of an airfoil 16 and a radial thickness of the associated shroud 30*a* at the point 32 of attachment with the airfoil tip 20 is constant across the first and second set of blades. In the illustrated embodiment, the shrouds 30*a* of the first set H have a tapering radial thickness away from the point 32 of attachment with the respective airfoil tip 20, such that circumferentially adjacent tip-shrouds 30*a* abut along the same radial thickness of the contact edges 42*a*, 44*a*.

In accordance with an alternate embodiment of the invention, a geometry of a mid-span shroud or snubber 30*b* may be modified for a set of blades in the blade row, so that said set of blades are mistuned, having a different frequency in relation to the rest of the blades in the row. The frequency of a snubbered blade may be affected by the mean radial thickness of the snubber and/or the location of the snubber along the span of the airfoil. Consequently, the thickness and/or the span-wise location of the snubber may be modified to change the frequency of the blades.

Figure 7:
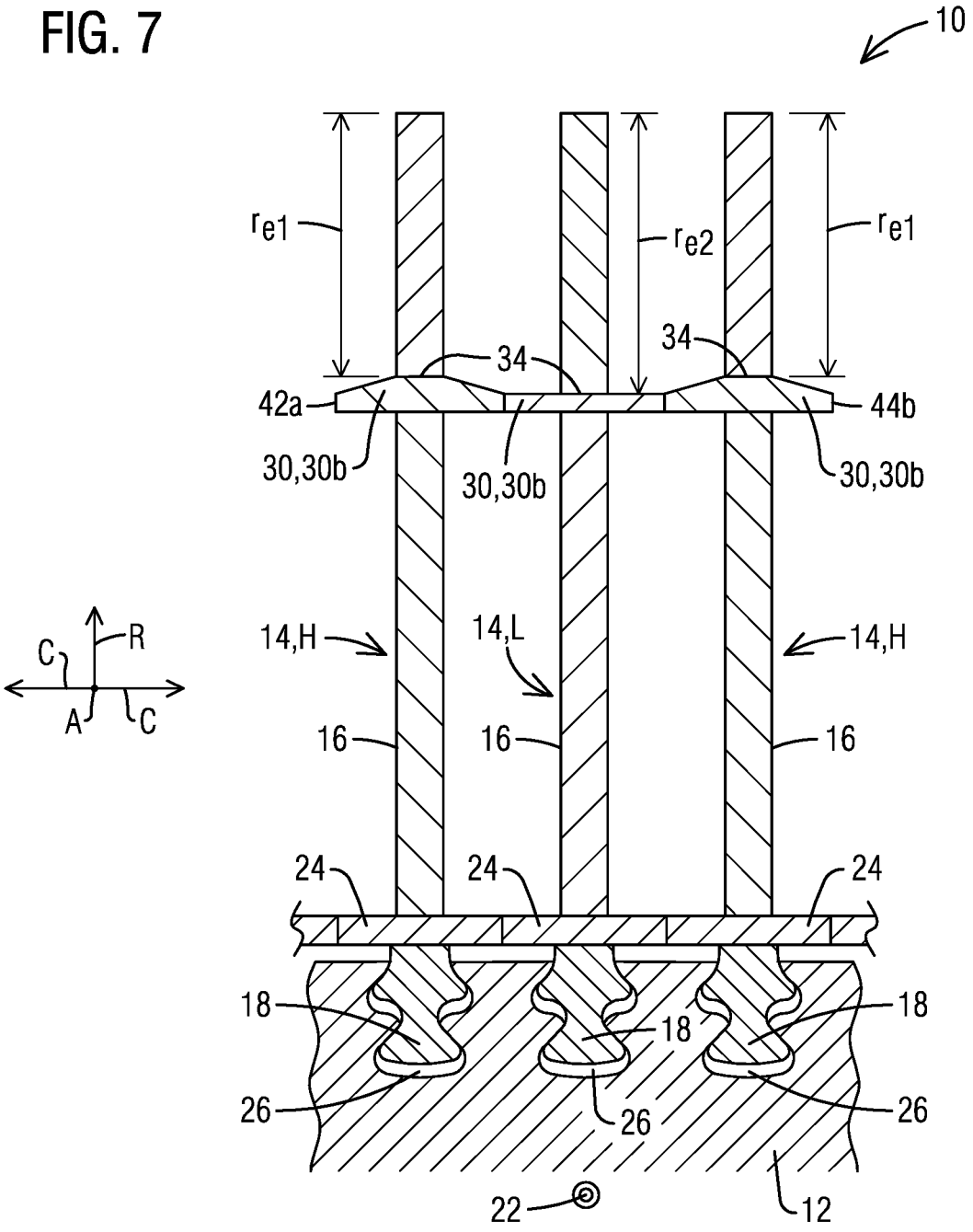
FIG. 7 is a schematic illustration of an axial end view of a row of blades having alternately mistuned snubbers, featuring a blade with a thin snubber between blades with thick snubbers according an example embodiment of the invention.

FIG. 7 shows portion of a bladed rotor system 10 having alternately mistuned snubbers 30*b* according to an example embodiment. The drawing features a mistuned blade with a thin snubber between regular blades with thick snubbers. As shown, the snubber 30*b* in the mistuned blade (belonging to the second set L) has a smaller mean radial thickness than the snubbers 30*b* of the blades in the first set H. As shown, the snubbers 30*b* in the first set H and the snubbers 30*b* in the second set L are attached to the respective airfoils 16 at different distances from the airfoil tips 20. Thereby, a free length $r_{e1}$ of the airfoils 16 in the first set H is smaller than a free length $r_{e2}$ of the airfoils 16 in the second set L. The free length of an airfoil 16 is defined as a radial distance between the airfoil tip 20 and a nearest point 34 of attachment of the associated snubber 30*b*. As a result of the alternating free lengths of the airfoils, the frequency of the blades 14 in the second set L will be lower than the frequency of the blades 14 in the first set H. In the illustrated embodiment, the snubbers 30*b* of the first set H have a tapering radial thickness away from the point 34 of attachment with the respective airfoil tip 20, such that circumferentially adjacent snubbers 30*b* abut along the same radial thickness of the contact edges 42*b*, 44*b*. As shown, the radial length of each airfoil 16 from the root portion 18 to the airfoil tip 20 is constant across the first and second sets of blades.

Figure 8:
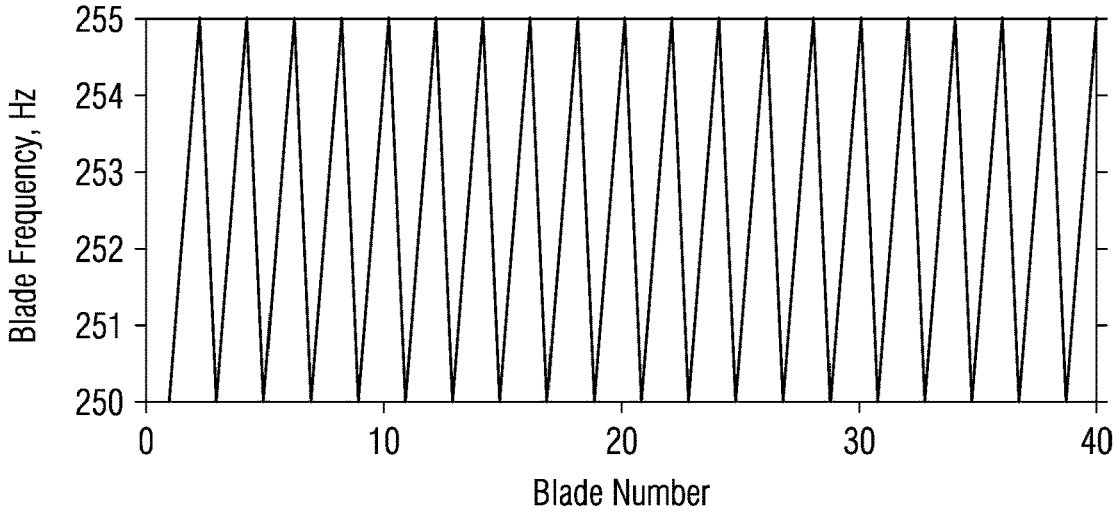
FIG. 8 graphically illustrates alternate mistuning in a row of turbine blades.

As an example, to effectively stabilize flutter, the shroud geometries may be modified to achieve a mistuning of about 1.5-2% above manufacturing tolerances. FIG. 8 graphically illustrates alternate mistuning in a row of 40 turbine blades. Herein, the odd number blades have a frequency of 250 Hz, while the even numbered blades have a frequency of 255 Hz. In this example, the difference in blade frequencies is 5 Hz. Consequently, the frequency of even numbered blades is 2% than the frequency of odd numbered blades, i.e., the amount of mistuning is 2%. In alternate examples, instead of odd and even high and low frequency blades, groups of one or more high and low frequency blades may alternate in a periodic fashion along the circumferential direction in the blade row, for example in patterns including HHLLHH, HHLHH, etc.

As illustrated above, the cross-sectional geometry of the airfoils about the rotation axis are essentially the same for both the high-frequency blades H and the low frequency blades L. The only difference between the airfoils in the high-frequency blades H and those in the low frequency blades L is the radial length of the airfoils, which is slightly longer for the low frequency (mistuned) blades L. This makes it easier to design the airfoil to have optimum aerodynamic efficiency since a uniform airfoil geometry has to be considered. Moreover, the illustrated embodiments make it possible to employ alternate mistuning for blades with hollow airfoils, for example, containing internal cooling channels. The design of hollow airfoils is more constrained than the design of solid airfoils. The use of mistuned tip-shrouds and snubbers provide a possibility for implementing alternate mistuning for such hollow blades without compromising the aero-efficiency.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

The invention claimed is:

1. A bladed rotor system for a turbomachine, comprising:

a circumferential row of blades mounted on a rotor disc, each blade comprising:

an airfoil extending span-wise along a radial direction from a root portion to an airfoil tip; and a shroud attached to the airfoil at a span-wise height of the airfoil, wherein in operation, shrouds of adjacent blades abut circumferentially, wherein the row of blades comprises a first set of blades and a second set of blades, the airfoils in the first set of blades and the second set of blades having substantially identical cross-sectional geometry about a rotation axis, wherein the blades of the second set are distinguished from the blades of the first set by a geometry of the shroud that is unique to the respective set, whereby the natural frequency of the blades in the second set differs from the natural frequency of the blades in the first set by a predetermined amount, wherein the blades of the first set and the blades of the second set alternate in a periodic fashion in said circumferential row, to provide a frequency mistuning to stabilize flutter of the blades, wherein the shrouds in the second set of blades have a smaller radial thickness in relation to the shrouds in the first set of blades at a region of attachment with the airfoils, wherein the shroud is a tip-shroud attached to the airfoil tip, and wherein the airfoils in the second set of blades have a correspondingly larger radial length from the root portion to the airfoil tip, in relation to the airfoils in the first set of blades, such that a sum total of the radial length of the airfoil and the radial thickness of the associated shroud is constant across the first set of blades and the second set of blades.

2. The bladed rotor system according to claim 1, wherein the shrouds of the first set of blades have a tapering radial thickness away from the region of attachment such that circumferentially adjacent shrouds abut along the same radial thickness.

3. A circumferential row of blades in a turbomachine comprising:

a first set of blades; and a second set of blades, wherein each blade in the first set of blades and the second set of blades comprising:

an airfoil extending span-wise along a radial direction from a root portion to an airfoil tip; and a shroud attached to the airfoil at a span-wise height of the airfoil, wherein the blade is designed to be identical to the first set of blades or the second set of blades in the row, wherein the airfoils in the first set of blades and the second set of blades have substantially identical cross-sectional geometry about a rotation axis, wherein the blades of the second set are distinguished from the blades of the first set by a geometry of the shroud that is unique to the respective set, whereby the natural frequency of the blades in the second set differs from the natural frequency of the blades in the first set by a predetermined amount, wherein the blades of the first set and the blades of the second set alternate in a periodic fashion in said circumferential row, to provide a frequency mistuning to stabilize flutter of the blades, wherein the shrouds in the second set of blades have a smaller radial thickness in relation to the shrouds in the first set of blades at a region of attachment with the airfoils, and wherein the shroud is a snubber attached at a mid-span of the airfoil.

4. The circumferential row of blades in a turbomachine according to claim 3, wherein the shrouds in the first set of blades and the shrouds in the second set of blades are attached to the respective airfoils at different distances from the airfoil tips, such that a free length of the airfoils in the first set of blades is smaller than a free length of the airfoils in the second set of blades, the free length of the airfoil being defined as a radial distance between the airfoil tip and a nearest region of attachment of the associated shroud.

5. The circumferential row of blades in a turbomachine according to claim 4, wherein the shrouds of the first set of blades have a tapering radial thickness away from the region of attachment such that circumferentially adjacent shrouds abut along the same radial thickness.

6. The circumferential row of blades in a turbomachine according to claim 3, wherein a radial length of each airfoil from the root portion to the airfoil tip is constant across the first set of blades and the second set of blades.

* * * * *